US010415607B2

(12) United States Patent
Weyland

(10) Patent No.: US 10,415,607 B2
(45) Date of Patent: Sep. 17, 2019

(54) MOBILE HYDRAULIC TOOL

(71) Applicant: TKR Spezialwerkzeuge GmbH, Gevelsberg (DE)

(72) Inventor: Thorsten Weyland, Herdecke (DE)

(73) Assignee: TKR Spezialwerkzeuge GmbH, Gevelsberg (DE)

( * ) Notice: Subject to any disclaimer, the term of this patent is extended or adjusted under 35 U.S.C. 154(b) by 400 days.

(21) Appl. No.: 14/951,971

(22) Filed: Nov. 25, 2015

(65) Prior Publication Data

US 2016/0153478 A1 Jun. 2, 2016

(30) Foreign Application Priority Data

Nov. 27, 2014 (DE) ..... 10 2014 117 403

(51) Int. Cl.

| | |
|---|---|
| ***B21D 9/05*** | (2006.01) |
| ***B21J 15/04*** | (2006.01) |
| ***F15B 15/14*** | (2006.01) |
| ***B25B 27/00*** | (2006.01) |
| ***B25B 27/02*** | (2006.01) |
| ***B25B 27/06*** | (2006.01) |

(52) U.S. Cl.

CPC ..... *F15B 15/1409* (2013.01); *B25B 27/0014* (2013.01); *B25B 27/026* (2013.01); *B25B 27/064* (2013.01)

(58) Field of Classification Search

CPC ..... F15B 15/1409; B25B 27/0014; B25B 27/026; B25B 27/064; B21D 9/05; B21J 15/18; B21J 15/06

USPC ..... 29/243.524

See application file for complete search history.

(56) References Cited

U.S. PATENT DOCUMENTS

| | | | | |
|---|---|---|---|---|
| 3,654,792 | A * | 4/1972 | Mead | B21J 15/105 29/243.524 |
| 4,462,240 | A | 7/1984 | Yamamoto | |
| 2006/0196029 | A1 | 9/2006 | Klann | |

(Continued)

FOREIGN PATENT DOCUMENTS

| | | | |
|---|---|---|---|
| DE | 867 939 | B | 7/1949 |
| DE | 29502918 | U1 | 8/1996 |
| DE | 20206000 | U1 | 9/2002 |

(Continued)

OTHER PUBLICATIONS

European Search Report and Written Opinion dated Apr. 26, 2016 in Application No. EP1519802.2 (German only) (7 pages).

(Continued)

*Primary Examiner* — David B Jones

(74) *Attorney, Agent, or Firm* — Nixon Peabody LLP

(57) ABSTRACT

The invention relates to a mobile hydraulic tool with a drive piston hydraulically adjustable between a start position and an end position, a hydraulic tool housing having a cylindrical section guiding the drive piston, and a tractive tool unit or pressing tool unit releasably connectable to the drive piston and the hydraulic tool housing. In order to provide a mobile hydraulic tool in which the movement provided by the drive piston can be used to optionally drive a tractive tool unit and a pressing tool unit, the hydraulic tool housing is designed on one side for arranging the tractive tool unit connectable to the drive piston, and on the other side for arranging the pressing tool unit connectable to the drive piston.

12 Claims, 2 Drawing Sheets

(56) References Cited

U.S. PATENT DOCUMENTS

2013/0104360 A1 5/2013 Liu

FOREIGN PATENT DOCUMENTS

| | | | |
|---|---|---|---|
| DE | 202005003450 | U1 | 5/2005 |
| DE | 202006014717 | U1 | 12/2006 |
| DE | 10 2008 013 044 | B3 | 7/2009 |
| DE | 202011005601 | U1 | 9/2011 |
| DE | 10 2012 103 803 | A1 | 5/2013 |
| DE | 20 2012 001 633 | U1 | 7/2013 |
| DE | 102012101894 | A1 | 9/2013 |
| EP | 0927585 | A2 | 7/1999 |
| EP | 0940227 | A2 | 9/1999 |
| EP | 2786843 | A2 | 10/2014 |

OTHER PUBLICATIONS

European Search Report and Written Opinion dated May 2, 2016 in Application No. EP15195717.4 (German only) (7 pages).

* cited by examiner

MOBILE HYDRAULIC TOOL

BACKGROUND OF THE INVENTION

Field of the Invention

The invention relates to a mobile hydraulic tool comprising:

- a drive piston hydraulically adjustable between a start position and an end position,
- a hydraulic tool housing having a cylindrical section guiding the drive piston, and
- a tractive or pressing tool unit releasably connectable to the drive piston and the hydraulic tool housing.

Description of Related Art

Mobile hydraulic tools of the initially-cited type are known in numerous designs from the prior art. The drive piston in the hydraulic tool housing which is hydraulically adjustable between the start position and end position serves to drive a tool unit connected to the mobile hydraulic tool. The tool unit is either a tractive or pressing tool unit. One typical embodiment of a tractive tool unit is for example a blind rivet setting unit in which the blind rivets are set by the tractive movement applied by the drive piston acting on the blind rivet. A pressing tool unit can for example be formed by a punching unit which is used to form openings in a component.

The disadvantage of known mobile hydraulic tools of the initially-cited type that are typically used in workshops is that they are used to either only operate a tractive tool unit, or to only operate a pressing tool unit. In the event that both traction as well as pressure generating tasks must be performed, the use of two mobile hydraulic tools is required that, if necessary, can be operated alternately using a hydraulic supply line. To perform the different tasks, it is however absolutely essential to keep two different hydraulic tools so that all of the tasks arising in the workshop can be performed. It however increases the cost of equipment of a workshop, and also means higher servicing, maintenance and repair costs.

BRIEF SUMMARY OF THE INVENTION

The object of the invention is to provide a mobile hydraulic tool in which the movement provided by the drive piston can be used to optionally drive a tractive tool unit and a pressing tool unit.

The invention achieves the object with a mobile hydraulic tool having the features of claim 1. Advantageous further embodiments of the invention are indicated in the dependent claims.

It is characteristic of the mobile hydraulic tool according to the invention that the hydraulic tool housing is designed on the one hand for arranging the tractive tool unit connectable to the drive piston, and on the other hand for arranging the pressing tool unit connectable to the drive piston. The option of arranging a tool unit on both sides of the hydraulic tool housing—along which the drive piston is adjustable within the hydraulic tool housing viewed in the longitudinal direction of the drive piston—and connecting the tool unit to the to drive piston makes it possible to use the adjusting movement of the drive piston between its start position and its end position both to drive a pressure generating tool unit, as well as to drive a tractive tool unit. The pressing tool unit is arrangeable on the side of the hydraulic tool housing in which the drive piston moves into the end position proceeding from the start position. Contrastingly, the tractive tool is arrangeable on the side of the hydraulic tool housing in which the drive piston moves into the start position proceeding from the end position.

The embodiment of the mobile hydraulic tool according to the invention accordingly makes it possible to use the mobile hydraulic tool both to perform tractive tasks as well as pressing tasks by means of exchangeable tractive tool units and pressing tool units adapted to the hydraulic tool housing. Depending on the intended purpose, the corresponding tool unit is easily arrangeable on the corresponding side of the hydraulic tool housing and connectable to the drive piston. The use of at least two mobile hydraulic tools for performing tractive and pressing tasks can be dispensed with due to the easy exchangeability of the tool units.

The tool units can in principle be connected to the hydraulic tool housing in any manner. Simple latching connections or locks like a bayonet lock are for example conceivable. According to one particularly advantageous design of the invention, it is however envisioned for the hydraulic tool housing to have a thread on both sides, in particular an inner thread, that on the one hand is designed to arrange the tractive tool unit and on the other hand to arrange the pressing tool unit.

The embodiment of the hydraulic tool housing according to the invention with two threads, in particular inner threads, preferably arranged on opposite ends viewed in the direction of adjustment of the drive piston, makes it possible to position the tool units connectable to the hydraulic tool housing in a particularly easy and reliable manner. The position of the tool units which are connected both to the hydraulic housing as well as to the drive piston for transmitting the adjusting movement thereof is particularly secure due to the connection established by the thread, such that pressing and tractive forces can be reliably transmitted to the tool units. In addition, the connection established by the threads protects the interior of the hydraulic tool housing, in particular the cylindrical section that serves to guide the drive piston, from contaminants which could cause the mobile hydraulic tool to malfunction.

The pressing tool unit and tractive tool unit are connected as disclosed above such that the movement of the drive piston is transferred to the tractive or pressing tool of the tractive tool unit or pressing tool unit. The tractive tool can, for example, be a set of clamping jaws; the pressing tool can be a punching head for a pressing tool. The drive piston can be designed in any manner so that it can be connected both to the tractive tool as well as the pressing tool. According to one particularly advantageous embodiment of the invention, the region of the end of the drive piston which faces the side of the hydraulic tool housing designed for arranging the tractive tool unit is designed to connect to a tractive tool, and the region of the end of the drive piston which faces the side of the hydraulic tool housing designed for arranging the pressing tool unit is designed to connect to a pressing tool.

According to this embodiment of the invention, the opposing ends of the drive piston are designed for arranging the pressing tool, or respectively the tractive tool, of the pressing tool unit, or respectively tractive tool unit. A corresponding design of the drive piston makes it possible to reliably connect the respective tool unit and the associated tool (tractive tool or pressing tool) to the hydraulic tool housing and the drive piston, independent of the design of the opposite ends of the drive piston. It is also possible to design the opposite ends of the drive piston differently corresponding to the tools to be used so that the hydraulic tool can be effectively adaptable to the tool units to be used. For connecting to the tractive tool and pressing tool, the drive piston can for example be provided with inner threads which enable a reliable connection of the drive piston to the tool.

According to another embodiment of the invention it is, however, provided that the drive piston has a longitudinal channel, in particular a through-hole. The use of a drive piston with a longitudinal channel, preferably a through-hole, makes it possible to connect the tractive tool unit and/or the pressing tool unit, or respectively the tractive tool, or respectively the pressing tool, to an end of the drive piston opposite the tool in a force fit and/or form fit. Accordingly, for example, the through-hole can be employed in order to use a pull rod that abuts the drive piston on the side opposite the tractive tool, and thereby converts an adjusting movement in which the drive piston presses against the pull rod into a tractive movement of the tractive tool. In a particularly advantageous manner, the end of the drive piston facing the end position has a stop surface surrounding the through-hole which enables effective and extensive contact with a coupling means, such as the pull rod as well as a pressing tool to ensure a reliable transmission of force.

The hydraulic tool housing is connected to a coupling which is connectable to a hydraulic line to drive the drive piston so that application of pressure causes the drive piston to move out of the start position to the end position in the cylindrical section of the hydraulic tool housing. According to one particularly advantageous design, the coupling for the hydraulic line is rotatably and/or pivotably connected to the hydraulic tool housing. This design of the invention makes it possible to suitably align the mobile hydraulic tool relative to the hydraulic line depending on the intended use so that the hydraulic tool can be comfortably operated.

BRIEF DESCRIPTION OF THE SEVERAL VIEWS OF THE DRAWINGS

An exemplary embodiment of the invention is described in the following in more detail with reference to the drawings. In the drawings.

DETAILED DESCRIPTION OF THE INVENTION

Figure 1:
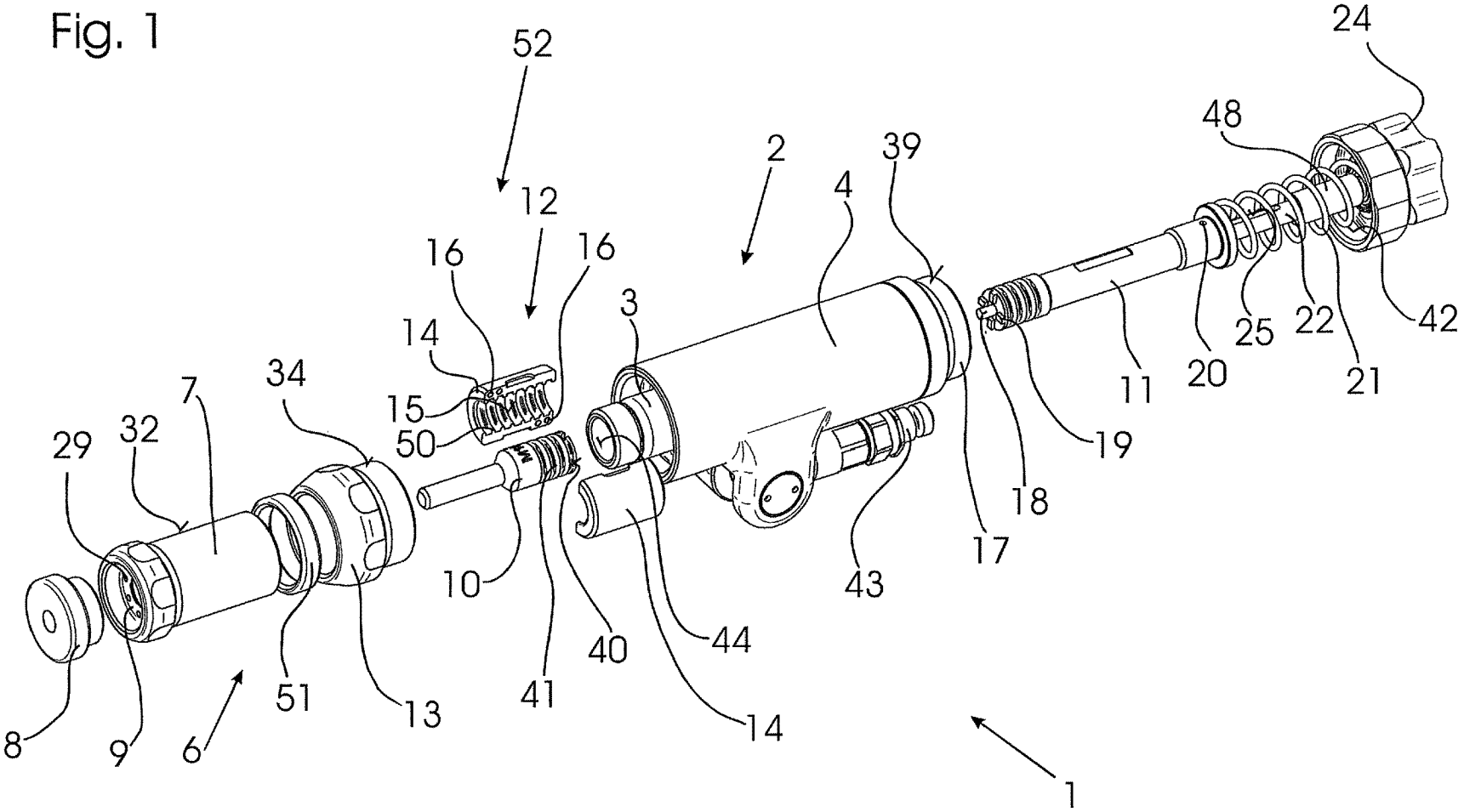
FIG. 1 shows an exploded view of a hydraulic tool.
Figure 2:
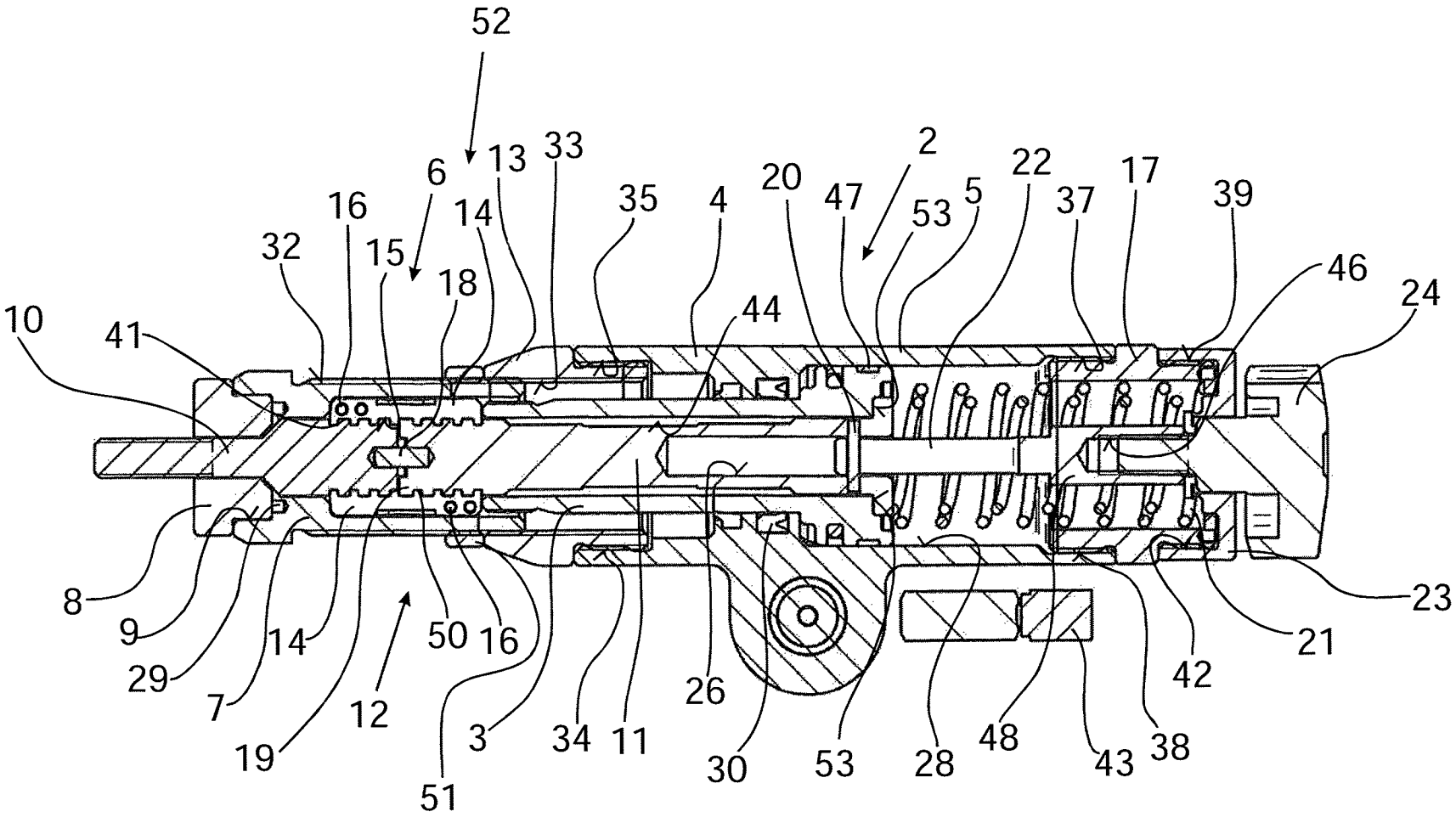
FIG. 2 shows a view of a section of the hydraulic tool from FIG. 1.

FIGS. 1 and 2 show a mobile hydraulic tool 1 designed as a riveting tool in an exploded view (FIG. 1) and in a sectional view (FIG. 2).

As a central component, the mobile hydraulic tool 1 has a drive unit 2 which has a hydraulic tool housing 4 as well as a drive piston 3 mounted in the hydraulic tool housing 4 to be adjustable between a start position and an end position. The drive piston 3 is adjusted hydraulically, wherein the drive piston 3 is mounted liquid-tight on a cylindrical inner surface 28 within the hydraulic tool housing 4 in a region of a cylindrical section 5 of the hydraulic tool housing 4 so that, when pressure is applied to the drive piston 3 by means of a hydraulic line (not shown) connectable to a coupling 43, a displacement of the drive piston 3 from the start position depicted in FIG. 2 to an end position (not shown) is effected. To seal the cylindrical section 5 of the hydraulic tool housing 4 which can be supplied with hydraulic fluid, a ring seal 30 is arranged within the hydraulic tool housing 4 for sealing against the drive piston 3, and a ring seal 47 lying on the cylindrical inner surface 28 is arranged on the drive piston 3.

In the embodiment of the mobile hydraulic tool 1 depicted here, the mobile hydraulic tool is designed as a riveting tool, wherein the hydraulic tool housing 4 and the drive piston 3 are connected to a tractive tool unit 52. The tractive tool unit 52 has inter alia a tractive tool 10 and a pull rod 11 which are coupled to the drive piston 3, and a sleeve seat 13 and a guide sleeve 7 which are connected to the hydraulic tool housing 4.

The drive piston 3 serves to adjust the pull rod 11 which is releasably connected via a coupling unit 12 to the tractive tool 10 in the direction of the longitudinal axis, and is connected in a form fit in the circumferential direction. The pull rod 11 extends in a through-hole 44 of the drive piston 3, wherein the insertion depth of the pull rod 11 into the drive piston 3 is limited by a flange which faces the drive piston 3 and lies against a stop surface 53 of the drive piston 3 in the direction of the longitudinal axis when in an installed state. For connecting the pull rod 11 to the tractive tool 10 by the coupling unit 12 in a form fit manner in the direction of the longitudinal axis and circumferential direction, the pull rod 11 and tractive tool 10 have annular circumferential projections 41 in a connecting section being in contact with the coupling unit 12. When in an installed state, two coupling half-shells 14 used to form the coupling unit 12 have inwardly projecting grooves 15 and bars 50 which engage in the grooves, arranged between the projections 41, in the pull rod 11 and tractive tool 10, and accordingly establish a form-fit connection in the direction of the longitudinal axis. In the installed state, the position of the coupling half-shells 14 is also secured by pins (not shown) that are arranged in one coupling half-shell 14 and engaged in pin seats 16 in the other coupling half-shell 14.

To connect the pull rod 11 and tractive tool 10 securely against rotation, they have bars 19 and grooves 40 which engage with the each other and run transversal to the direction of the longitudinal axis in the contact area facing each other, wherein the bars 19 are arranged crosswise on the end face facing the tractive tool 10, and the tractive tool 10 has grooves 40 designed correspondingly cross-shaped in the end face facing the pull rod 11. In an installed state, a centring pin 18 projecting from the end face of the pull rod 11 toward the tractive tool 10 furthermore serves to secure the position of the tractive tool 10 relative to the pull rod 11, wherein the tractive tool 10 engages in a correspondingly formed hole in the tractive tool 10. To guide the tractive tool 10 between the position assigned to the rivet seat position and setting position of the pull rod 11, the tractive tool 10 is provided with a guide sleeve 7 forming a guide unit 6 which is adapted on the inside to the diameter of the coupling unit 12 and therefore functions as a linear guide. The guide sleeve 7 is fastened via an outer thread 32 to an inner thread 33 of a sleeve seat 13 that is fixed via an outer thread 34 to an inner thread 35 arranged in the hydraulic tool housing 4. A securing ring 51 which is arranged coaxially to the guide sleeve 7 and abuts an end face of the sleeve seat 13 serves to secure the position of the guide sleeve 7 on the sleeve seat 13.

To receive a rivet head 8 adapted to the tractive tool 10, the guide sleeve 7 has a rivet head seat 9 within which a plurality of retaining magnets 29, coaxial to the through-hole, are annularly arranged which enable a releasable attachment of the rivet head 8 to the guide sleeve 7.

Together with a guide pin 22, a threaded sleeve 23, a rotary knob 24 and a helical compression spring 21, the pull rod 11 releasably connected to the tractive tool 10 forms a component which is unreleasably connected during normal operation. The pull rod 11 has a hole 26 within which the guide pin 22 can be axially moved. The axial movability is established by the length of a slot 25 extending through the guide pin 22 in the direction of the longitudinal axis, wherein a securing bolt 20 connected to the pull rod 11 extends through this slot 25. The securing bolt 20 also guarantees transmission of the rotary movements of the securing pin 22 to the pull rod 11, wherein this rotary movement is then transferred to the tractive tool 10.

The rotary movement of the guide pin 22 is generated by actuating a rotary knob 24 which is arranged nonrotatably in a seat opening 46 of a seat section 48 of the guide pin 22. For releasably arranging the assembly consisting of the pull rod 11, guide pin 22, threaded sleeve 23, helical compression spring 21 and rotary knob 24 on the hydraulic tool housing 4, the threaded sleeve 23 has an inner thread 42 which can be screwed onto an outer thread 39 of an adapter bushing 17, wherein an additional outer thread section 38 of the adapter bushing 17 can be screwed into an inner thread 37 of the hydraulic tool housing 4. By means of the adapter bushing 17, different tool units can be combined with the standardized hydraulic tool housing 4 of the mobile hydraulic tool 1.

One end of the helical compression spring 21 is supported by an inner surface of the threaded sleeve 23, and the other end is supported by a flange of the pull rod 11. In an installed state, the helical compression spring 21 accordingly pretensions the pull rod 11 toward the drive piston 3. A movement of the drive piston 3 as well as the pull rod 11 connected in a form fit manner in the direction of the longitudinal axis to the drive piston 3 out of the start position into the end position therefore occurs counter to the spring force of the helical compression spring 21.

The inner threads 35, 37 arranged on both sides on the opposing ends of the hydraulic tool housing 4 allows the mobile hydraulic tool 1 with a tractive tool unit 52 or a pressing tool unit (not shown) to be easily converted.

LIST OF REFERENCE SIGNS

1 Hydraulic tool
2 Drive unit
3 Drive piston
4 Hydraulic tool housing
5 Cylindrical section
6 Guide unit
7 Guide sleeve
8 Rivet head
9 Rivet head seat
10 Tractive tool
11 Pull rod
12 Coupling unit
13 Sleeve seat
14 Coupling half-shell
15 Grooves
16 Pin seat
17 Adapter bushing
18 Centering pin
19 Bars
20 Securing bolt
21 Helical compression spring
22 Guide pin
23 Threaded sleeve
24 Rotary knob
25 Slot
26 bore hole
28 Cylindrical inner surface
29 Retaining magnet
30 Ring seal
32 Outer thread
33 Inner thread
34 Outer thread
35 Inner thread
37 Inner thread
38 Outer thread
39 Outer thread
40 Grooves
41 Projections
42 Inner thread
43 Coupling
44 Through-hole
46 Seat opening
47 Ring seal
48 Seat section
50 Bars
51 Securing ring
52 Tractive tool unit

I claim:

1. A mobile hydraulic tool comprising:

a drive piston hydraulically adjustable between a first position and second position in a longitudinal direction of the drive piston, a hydraulic tool housing having a cylindrical section guiding the drive piston, and a tool unit releasably connectable to the drive piston and the hydraulic tool housing, wherein movement of the drive piston between the first position and the second position drives the tool unit, a coupling for rotatably and/or pivotably receiving a hydraulic line, wherein the hydraulic line supplies hydraulic fluid to the hydraulic tool housing, wherein the hydraulic tool housing is configured to receive on a first side of the hydraulic tool housing a tractive tool unit connectable to the drive piston, wherein the first side is a side of the hydraulic tool housing in which the drive piston moves into the first position proceeding from the second position, and configured to receive on a second side of the hydraulic tool housing a different tool unit connectable to the drive piston, wherein the second side is opposite the first side and is a side of the hydraulic tool housing in which the drive piston moves into the second position from the first position, comprises a first thread on the first side configured to receive the tractive tool unit, and comprises a second thread on the second opposing side configured to receive the different tool unit.

2. The mobile hydraulic tool according to claim 1, wherein the tool unit is a tractive tool unit having a tractive tool, and the drive piston has a first end and second end opposite the first end, wherein the first end is configured to receive the tractive tool of the tractive tool unit, and the second end is configured to receive a different tool.

3. The mobile hydraulic tool according to claim 1, wherein the drive piston has a longitudinal channel configured as a through-hole.

4. The mobile hydraulic tool according to claim 3, wherein an end of the drive piston facing the second position has a stop surface surrounding the through-hole.

5. The mobile hydraulic tool according to claim 1, wherein a first end of the drive piston which faces the first side of the hydraulic tool housing configured to receive a tractive tool, and second end of the drive piston which faces the second side of the hydraulic tool housing is configured to receive a different tool.

6. The mobile hydraulic tool according to claim 2, wherein the drive piston has a longitudinal channel configured as a through-hole.

7. The mobile hydraulic tool according to claim 1, wherein an end of the drive piston facing the second position has a stop surface surrounding the through-hole.

8. The mobile hydraulic tool according to claim 6, wherein an end of the drive piston facing the second position has a stop surface surrounding the through-hole.

9. The mobile hydraulic tool according to claim 1, wherein the first thread and the second thread comprise an inner thread.

10. A mobile hydraulic tool comprising:

a hydraulic drive piston adjustable between a start position and an end position in a longitudinal direction of the drive piston, a hydraulic tool housing having a cylindrical section for guiding the drive piston, a coupling for rotatably and/or pivotably receiving a hydraulic line, wherein the hydraulic line supplies hydraulic fluid to the hydraulic tool housing, and a tool unit releasably connectable to the drive piston and the hydraulic tool housing, wherein the hydraulic tool housing includes a thread on a first side designed for arranging a tractive tool unit connectable to the drive piston, and includes a thread on an opposing side designed for arranging a different tool unit connectable to the drive piston.

11. The mobile hydraulic tool unit according to claim 10, wherein the tool unit includes a tractive tool unit having a tractive tool, and the drive piston has a first end and an opposing end, and wherein the first end of the drive piston is designed to connect to the tractive tool of the tractive tool unit and the opposing end of the drive piston is designed to connect to a different tool.

12. A mobile hydraulic tool comprising:

a drive piston hydraulically adjustable between a first position and a second position in a longitudinal direction of the drive piston, a hydraulic tool housing having a cylindrical section guiding the drive piston, a tool unit releasably connectable to the drive piston and the hydraulic tool housing, wherein movement of the drive piston between the first position and the second position drives a tool unit, and a coupling for rotatably and/or pivotably receiving a hydraulic line, wherein the hydraulic line supplies hydraulic fluid to the hydraulic tool housing, wherein the hydraulic tool housing comprises a first thread on a first side to receive a tractive tool unit for being connected to the drive piston, wherein the first side is a side of the hydraulic tool housing in which the drive piston moves into the first position proceeding from the second position, and comprises a second thread on a second side to receive a different tool unit for being connected to the drive piston, wherein the second side is opposite the first side and is a side of the hydraulic tool housing in which the drive piston moves into the second position from the first position.

* * * * *